US010749279B2

(12) United States Patent
Starke et al.

(10) Patent No.: US 10,749,279 B2
(45) Date of Patent: Aug. 18, 2020

(54) SHIELDED CIRCULAR PLUG-IN CONNECTOR

(71) Applicant: Phoenix Contact GmbH & Co. KG, Blomberg (DE)

(72) Inventors: Cord Starke, Blomberg (DE); Kathrin Dober, Lemgo (DE); Daniel Nolting, Hiddenhausen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/199,257

(22) Filed: Nov. 26, 2018

(65) Prior Publication Data

US 2019/0165495 A1 May 30, 2019

(30) Foreign Application Priority Data

Nov. 28, 2017 (DE) ..... 10 2017 128 089

(51) Int. Cl.

| | |
|---|---|
| ***H01R 4/38*** | (2006.01) |
| ***H01R 4/30*** | (2006.01) |
| ***H01R 13/627*** | (2006.01) |
| ***H01R 13/6582*** | (2011.01) |
| ***H01R 13/622*** | (2006.01) |

(Continued)

(52) U.S. Cl.

CPC ..... *H01R 4/302* (2013.01); *H01R 13/622* (2013.01); *H01R 13/627* (2013.01); *H01R 13/6582* (2013.01); *H01R 13/6583* (2013.01); *H01R 13/5219* (2013.01)

(58) Field of Classification Search

CPC ..... H01R 13/625; H01R 13/622; H01R 2103/00; F21S 6/002

USPC ..... 439/314, 320, 322, 323, 585

See application file for complete search history.

(56) References Cited

U.S. PATENT DOCUMENTS 3,986,765 A * 10/1976 Shaffer ..... H01R 13/625 439/314

4,131,332 A * 12/1978 Hogendobler ..... H01R 9/0518 439/585

(Continued)

FOREIGN PATENT DOCUMENTS

DE 102008018809 A1 10/2009

JP 2003086295 A 3/2003

(Continued)

*Primary Examiner* — Thanh Tam T Le

(74) *Attorney, Agent, or Firm* — Leydig, Voit & Mayer, Ltd.

(57) ABSTRACT

A circular plug-in connector for establishing a shielded plug-in connection to a mating plug-in connector includes: a contact carrier having at least one electrical contact element; a shielding sleeve that surrounds the contact carrier at least in part; and a screw housing that is rotatably connected to the shielding sleeve and adapted to screw the circular plug-in connector to the mating plug-in connector. A connection portion of the shielding sleeve is received in a receiving space of the screw housing The circular plug-in connector provides shielded contact between the screw housing and the shielding sleeve. The shielding sleeve includes a collar in the connection portion. The circular plug-in connector further includes a stopper for closing a receiving opening of the receiving space at least in part, such that the collar is trapped in the receiving space.

15 Claims, 4 Drawing Sheets

(51) Int. Cl.
*H01R 13/6583* (2011.01)
*H01R 13/52* (2006.01)

(56) References Cited

U.S. PATENT DOCUMENTS 4,634,208 A * 1/1987 Hall ..... H01R 9/032 439/607.51
4,799,902 A * 1/1989 Laudig ..... H01R 24/562 439/580
4,810,210 A * 3/1989 Komatsu ..... H01R 9/032 439/607.4
4,921,447 A * 5/1990 Capp ..... H01R 43/0207 439/585
7,018,220 B2 * 3/2006 Zemba ..... H01R 9/032 439/98
7,029,305 B2 * 4/2006 Weidner ..... H01R 9/05 439/322
7,727,021 B2 * 6/2010 Haruna ..... H01R 9/037 439/607.41
7,896,687 B1 * 3/2011 Schweitzer ..... H01R 9/032 439/320
8,123,554 B2 * 2/2012 Leipold ..... H01R 9/05 439/17
8,210,863 B2 * 7/2012 Johnson ..... H01R 13/622 439/218
8,333,611 B2 * 12/2012 Perndl ..... H01R 4/625 439/578
2004/0077215 A1 4/2004 Palinkas et al.
2011/0097929 A1 4/2011 Leipold et al.

FOREIGN PATENT DOCUMENTS

JP 2010153268 A 7/2010
JP 2013004282 A 1/2013

* cited by examiner

SHIELDED CIRCULAR PLUG-IN CONNECTOR

CROSS-REFERENCE TO PRIOR APPLICATION

Priority is claimed to German Patent Application No. DE 10 2017 128 089.8, filed on Nov. 28, 2017, the entire disclosure of which is hereby incorporated by reference herein.

FIELD

The invention relates to a circular plug-in connector for establishing a shielded plug-in connection to a mating plug-in connector.

BACKGROUND

A circular plug-in connector of this type connects the ends of electrical wires, with electrical shielding of the plug-in connection being achieved at the same time. In particular, there can be continuous shielding of the wires across the plug-in connection.

A circular plug-in connector of this type comprises a contact carrier having at least one electrical contact element, a shielding sleeve that surrounds the contact carrier at least in part, and a screw housing that is rotatably connected to the shielding sleeve and provided for a screw connection between the circular plug-in connector and the mating plug-in connector part. In this case, a connection portion of the shielding sleeve is received in a receiving space of the screw housing. Furthermore, the circular plug-in connector is designed such that there is a shield connection between the screw housing and the shielding sleeve.

In conventional circular plug-in connectors of this type, the shielding sleeve is movably received in the screw housing in parallel with the plug-in direction. A spring element made of electrically conductive material is arranged between the screw housing and the shielding sleeve in this case. The spring element provides a shield connection between the screw housing and the shielding sleeve irrespective of a position of the shielding sleeve in the axial direction. At the same time, the spring element is designed such that it does not significantly impair the ability of the screw housing to rotate relative to the shielding sleeve. A spiral spring or wave spring washer, for example, is used as a spring element.

Difficulties may arise in these circular plug-in connectors owing to the fact that the shield connection between the spring element and the part of the device that abuts said element takes place over a relatively small contact region. The shielded contact is therefore typically linear in the case of a spiral spring and punctiform in the case of a spring washer. As a result, the quality of the contact may be impaired. Moreover, when the plug-in connection is screwed, the contact carrier, and thus also the shielding sleeve, is pushed relative to the screw housing into a furthest position counter to the plug-in direction. The spring element is thus as relaxed as possible, and the contact pressure of the spring element is minimized. This can result in the shielded contact being temporarily broken in the case of strong vibrations, for example.

Structural solutions for securing shielded contact are particularly complicated for smaller circular plug-in connectors.

There is therefore a need for a plug-in connector part that mitigates or avoids the above-mentioned problems.

SUMMARY

In an embodiment, the present invention provides a circular plug-in connector for establishing a shielded plug-in connection to a mating plug-in connector, comprising: a contact carrier having at least one electrical contact element; a shielding sleeve that surrounds the contact carrier at least in part; and a screw housing that is rotatably connected to the shielding sleeve and configured to screw the circular plug-in connector to the mating plug-in connector, wherein a connection portion of the shielding sleeve is received in a receiving space of the screw housing, wherein the circular plug-in connector is configured such that there is shielded contact between the screw housing and the shielding sleeve, wherein the shielding sleeve comprises a collar in the connection portion, and wherein the circular plug-in connector further comprises a stopper configured to close a receiving opening of the receiving space at least in part, such that the collar is trapped in the receiving space.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
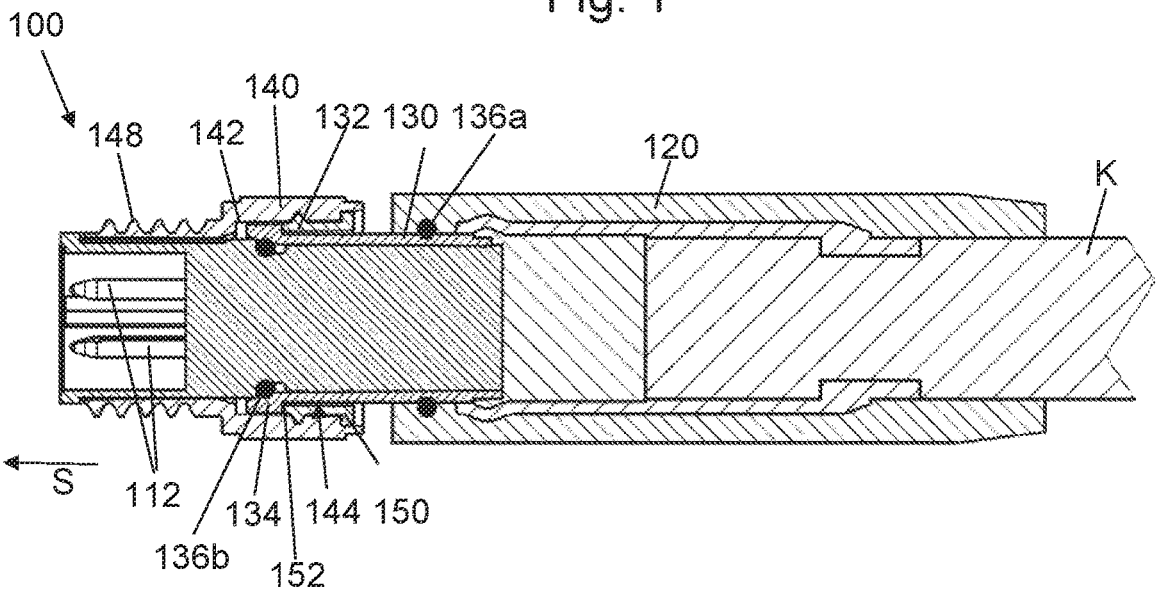
FIG. 1 schematically shows a cross-sectional view of a circular plug-in connector according to one embodiment.

In an embodiment, the present invention provides a shielding sleeve comprising a collar in the connection portion, and the circular plug-in connector further comprises a stopper designed for closing a receiving opening of the receiving space at least in part, such that the collar is trapped in the receiving space.

The screw housing, the shielding sleeve and the stopper can comprise electrically conductive material. In this case, the screw housing, the shielding sleeve and the stopper can be made of metal, at least substantially.

The stopper can comprise an end face that is designed at least in part for planar contact via the collar. In this case, the end face can be designed for planar contact via the collar when the circular plug-in connector is screwed to the mating plug-in connector part by means of the screw housing. The end face can additionally comprise an end contour. The end contour can also be provided for engaging in a mating contour of the collar, when the circular plug-in connector is screwed to the mating plug-in connector part by means of the screw housing, in order to form vibration protection, in particular against undesired unscrewing of the screw housing. The end contour can be segmented. In this case, segments of the end contour that are arranged in parallel with a contact surface of the collar can comprise tooth-shaped recesses designed for forming vibration protection together with teeth of the mating contour of the collar that face said recesses.

In addition, the stopper can be designed for being fastened to the screw housing by being screwed in and/or by being inserted and twisted in order to close the receiving opening at least in part.

The screw housing can comprise at least one internal thread and/or at least one internal thread segment in a region of the receiving opening. Furthermore, the stopper can comprise at least one external thread and/or at least one external thread segment for screwing the stopper into the receiving opening. In this case, the internal thread and/or the internal thread segment can comprise an internal thread demolded by unscrewing or an internal thread segment demolded by unscrewing. The screw housing and the stopper can be produced by means of zinc die casting, at least in part.

Additionally or alternatively, the internal thread and/or the internal thread segment can comprise a conical internal thread and/or a conical internal thread segment. These can be produced by means of milling, at least in part.

Additionally or alternatively, the screw housing can comprise at least one undercut contour in a region of the receiving opening. The stopper can comprise, on an outer face, at least one mating undercut contour that is designed for being brought into engagement with the undercut contour of the screw housing in order to fasten the stopper in the receiving opening by means of plugging-in and twisting. The screw housing and the stopper can be produced by means of milling, at least in part.

The circular plug-in connector can be designed such that the stopper on the screw housing can be non-detachably fastened to the screw housing by press-fitting at least one thread, at least one undercut contour and/or material of the circular plug-in connector in a region that is adjacent to an undercut contour of the circular plug-in connector. In particular, the circular plug-in connector can be designed such that the stopper on the screw housing can be non-detachably fastened to the screw housing by press-fitting material of the stopper and/or of the screw housing in a region that is adjacent to an undercut contour of the stopper and/or of the screw housing. The stopper can comprise at least one aperture provided for press-fitting an internal thread and/or internal thread segment located thereunder and/or an undercut contour, located thereunder, of the screw housing when the stopper is fastened to the screw housing.

The receiving opening of the screw housing can be designed such that it allows the connection portion of the shielding sleeve to be inserted into the receiving space when the receiving opening is not at least partially closed by means of the stopper. In particular, the receiving opening can be designed for the collar to be inserted into the receiving space.

The screw housing can be connected to the shielding sleeve so as to be rotatable about a longitudinal axis of the contact carrier that is parallel to the plug-in direction. Moreover, the screw housing can comprise at least one thread for screwing to the mating plug-in connector part. The screw housing can surround the contact element, at least in part, in a direction radial to a longitudinal axis of the contact carrier.

The circular plug-in connector can comprise an angled circular plug-in connector. Alternatively, the circular plug-in connector can comprise a straight circular plug-in connector.

FIG. 1 schematically shows a cross-sectional view of a circular plug-in connector 100 according to one embodiment. The circular plug-in connector 100 is provided for establishing a shielded plug-in connection to a mating plug-in connector.

The circular plug-in connector 100 comprises a contact carrier 110 comprising a plurality of contact elements 112 for contacting one or more mating contact elements of a mating plug-in connector. The contact carrier 110 is enclosed in a grip body 120 of the circular plug-in connector 100. A cable K is also received in the grip body 120. The contact elements 112 are electrically connected to at least one wire of the cable K.

The circular plug-in connector 100 comprises a shielding sleeve 130 that surrounds the contact carrier 110 at least in part and forms part of a shielding of the circular plug-in connector 100 in the region of the contact carrier 110. The circular plug-in connector 100 further comprises a screw housing 140 that is fastened to the grip body 120 so as to be rotatable relative to the contact carrier 110. The screw housing 140 comprises a receiving space 142 that can be accessed through a receiving opening 144 on an end of the screw housing 140 that is the rear end in the plug-in direction S. The screw housing 140 further comprises a screw thread 148 for a screw connection between the circular plug-in connector 100 and the mating plug-in connector. A screw connection of this type secures the plug-in connection against accidental detachment, for example. In some examples, the screw connection is also provided for continuously shielding the entire plug-in connection, for example for continuously shielding the cable K, and a mating cable connected thereto, across the plug-in connection.

The shielding sleeve 130 is received in the receiving space 142 of the screw housing 140 by means of a connection portion 132. The receiving opening 144 is for example designed such that the connection portion 132 can be inserted into the receiving space 142 through the receiving opening 144. The shielding sleeve 130 comprises a collar 134 on an end that is the front end in the plug-in direction. The screw housing 140 is secured against detaching from the shielding sleeve 130 by means of a stopper 150 which partially closes the receiving opening 144 behind the collar 134. In the example shown, the stopper 150 is provided with two external thread segments that engage in an internal thread of the screw housing 140 in the region of the receiving opening 144 for this purpose. The stopper 150 is designed such that an end face 152 of the stopper 150 comes into planar contact with the collar 134 when the shielding sleeve 130 is pushed relative to the screw housing 140 in a direction that a backward direction with respect to the plug-in direction S.

In order to form a shielding of the plug-in connection, the shielding sleeve 130, the stopper 150 and the screw housing 140 each surround part of the contact carrier 110 including the contact elements 112. The shielding sleeve 130, the screw housing 140 and the stopper 150 are made of electrically conductive material or comprise electrically conductive material, for example. The circular plug-in connector 100 allows shielded contact between the screw housing 140 and the shielding sleeve 130 by means of contact between the stopper 150 and the screw housing 140, and between the stopper 150 and the collar 134 of the shielding sleeve 130 via the end face 152 of the stopper 150. The contact between the shielding sleeve 130 and the stopper 150 is achieved in the form of extensive planar contact between the collar 134 and the end face 152. A quality of the contact can thus be improved with respect to a punctiform or linear contact region, which would for example occur if spring elements were used, as is conventional.

When there is a screw connection between the screw housing 140 and a mating plug-in connector, the contact carrier 110, and thus also the shielding sleeve 130 including the collar 134, is pushed relative to the screw housing 140 counter to the plug-in direction S. The collar 134 is thus pushed against the end face 152 of the stopper 150, as a result of which the shielded contact between the end face 152 and the collar 134 is produced when the circular plug-in connector 100 is in the screwed state, and is additionally effectively secured against breaking of the shielded contact.

In some examples, the end face 152 additionally comprises an end contour that engages in a mating contour of the collar 134 in order to form vibration protection, for example against undesired unscrewing of the screw housing 140. In some examples, the end contour is segmented, with segments of the end contour that are arranged in parallel with the contact surface of the collar 134 comprising tooth-shaped recesses that form vibration protection together with teeth of the mating contour of the collar that face said recesses. The vibration protection provides additional security against undesired unscrewing of the screw housing, and therefore also against breaking of the shielded contact.

In the example shown, the circular plug-in connector 100 further comprises a plurality of sealing elements 136*a*, 136*b*. These are used as an enclosure and/or seal for transitions between different parts of the circular plug-in connector 100, for example.

The example shown in FIG. 1 is a straight circular plug-in connector 100. The techniques described can, however, also be used in connection with other circular plug-in connectors, for example angled circular plug-in connectors. In addition, a threaded connection between the receiving opening 144 of the screw housing 140 and the stopper 150 is provided in connection with the example from FIG. 1. The advantages described above can, however, also be achieved using other types of connection, in particular various threaded connections or other connections, for example comprising undercut contours, as will be described in more detail in the following.

Figure 2:
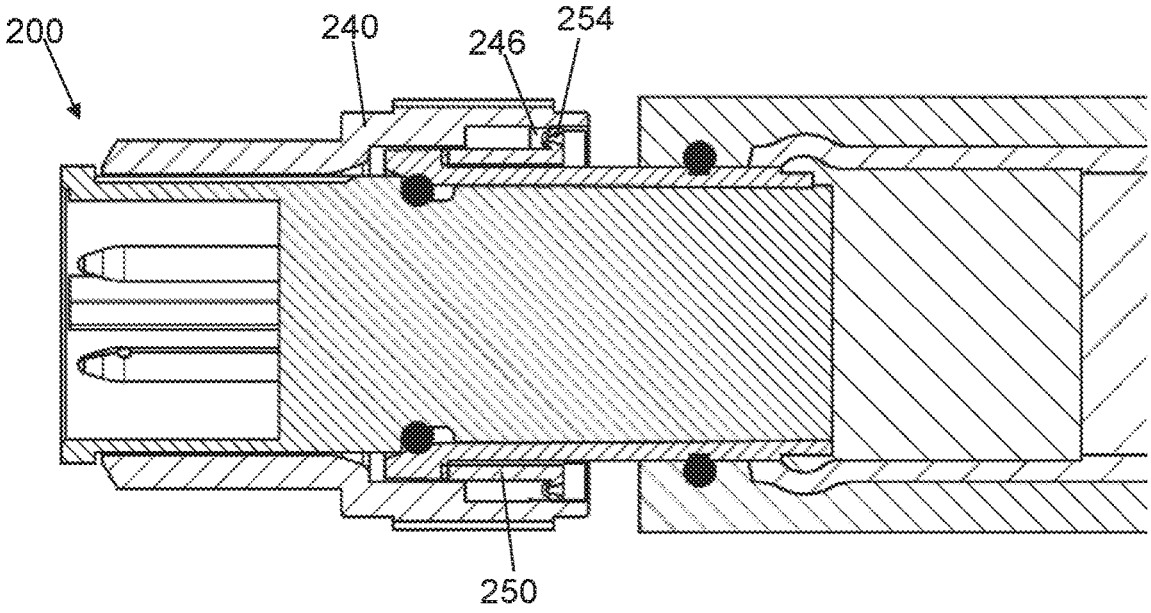
FIG. 2 schematically shows a detail of a cross-sectional view of a circular plug-in connector according to another embodiment.

FIG. 2 schematically shows a detail of a cross-sectional view of a circular plug-in connector 200 according to another example. Unless indicated otherwise in the following, the same as was stated in connection with the circular plug-in connector 100 from FIG. 1 also applies to the circular plug-in connector 200.

In contrast with the example from FIG. 1, the screw housing 240 of the circular plug-in connector 200 comprises an undercut contour 246, instead of a thread, for connection to the stopper 250. In this case, the undercut contour 246 engages in a mating undercut contour 254 on the outer face of the stopper 250. The stopper 250 is fastened to the screw housing 240 by plugging the stopper 250 into the screw housing 240 and then rotating the undercut contour 246 and the mating undercut contour 254 relative to one another by twisting the stopper 250. In the example shown, material of the stopper 250 that is adjacent to the undercut contour 246 of the screw housing 240 is also deformed, for example by press-fitting, in front of the undercut contour 246 of the screw housing 240 after the stopper 250 has been inserted and twisted, in order to thus prevent the stopper 250 subsequently rotating relative to the screw housing 240. In this way, the stopper 250 is irreversibly fastened to the screw housing 240, as a result of which undesired detachment of the stopper 250 is prevented, for example. In other examples, the undercut contour 246 and/or the mating undercut contour 254 itself is provided for deforming in order to prevent the stopper 250 from rotating after the stopper 250 has been fastened.

Figure 3A:
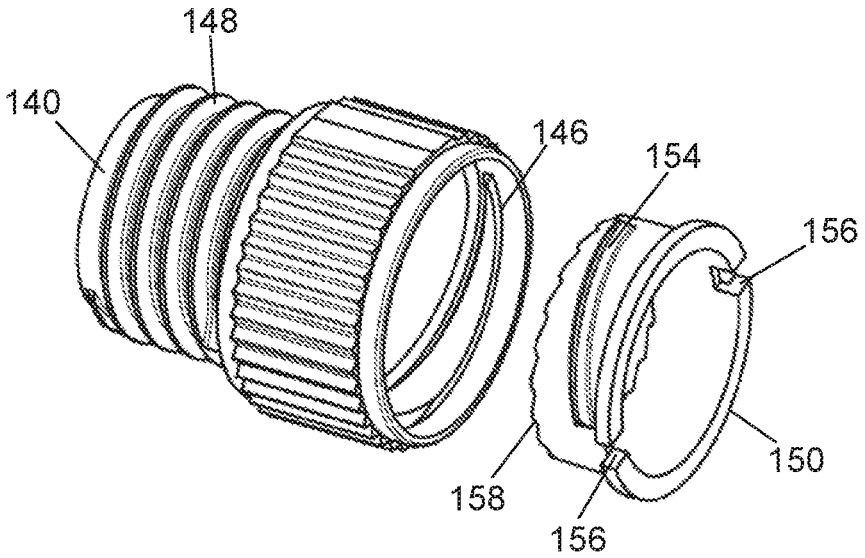
FIG. 3A schematically shows a perspective view of a screw housing and a stopper for a circular plug-in connector according to one embodiment.
Figure 3B:
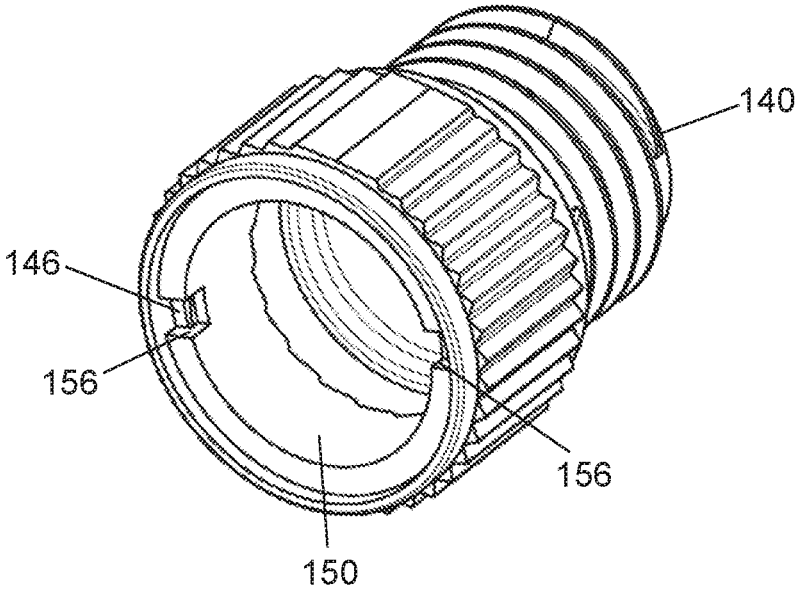
FIG. 3B schematically shows a perspective view of a screw housing and a stopper fastened therein for a circular plug-in connector according to one embodiment.

FIGS. 3A and 3B show a screw housing 140 and a stopper 150 in different arrangements. The screw housing 140 and the stopper 150 are for example those described in connection with FIG. 1. Reference signs in FIGS. 3A and 3B that are identical to those in FIG. 1 denote the same features.

FIG. 3A shows an internal thread 146 of the screw housing 140 in the region of the receiving opening 144. Furthermore, external thread segments 154 are provided on an outer face of the stopper 150. The external thread segments 154 are for screwing to the internal thread 146 of the screw housing 140. In the example shown, the end face of the stopper 150 comprises an end contour 158 for forming vibration protection together with a mating contour on the collar of the shielding sleeve. In some examples, the screw housing 140 and the stopper 150 are produced by means of zinc die casting. In some examples, the internal thread 146 is a thread that is demolded by unscrewing in the zinc die casting tool.

The stopper 150 additionally comprises a plurality of apertures 156. The apertures 156 are provided for allowing the internal thread 146 to be deformed, for example by press-fitting, in a region adjacent to each of the external thread segments 154 after the stopper 150 has been screwed into the screw housing 140. Press-fitting or otherwise deforming the internal thread 146 in this way prevents undesired detachment of the stopper 150 from the screw housing 140, similar to the press-fitting of the undercut contour 246 described in connection with FIG. 2.

FIG. 3B shows the screw housing 140 and the stopper 150 from FIG. 3A, the stopper 150 being screwed into the screw housing 140. In this case, each aperture 156 of the stopper 150 provides access to part of the internal thread 146 of the screw housing 140. Deformation of the internal thread 146 is thus promoted in the region of the apertures 156.

Figure 4:
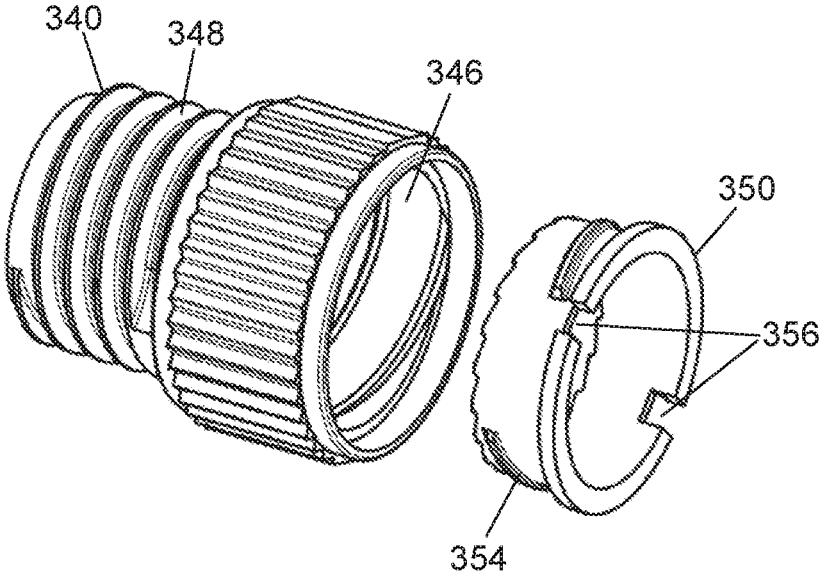
FIG. 4 schematically shows a perspective view of a screw housing and a stopper for a circular plug-in connector according to another embodiment.

FIG. 4 schematically shows a perspective view of a screw housing 340 and a stopper 350 for use in a circular plug-in connector according to another embodiment. Unless indicated otherwise in the following, the same as was previously stated also applies to the screw housing 340, the stopper 350 and a circular plug-in connector provided for use therewith.

The screw housing 340 also comprises a screw thread 348 for screwing to a mating plug-in connector. Furthermore, the stopper 350 also comprises a plurality of apertures 356 that promote securing of the connection between the stopper 350 and the screw housing 340 by press-fitting or other deforming. Unlike the example from FIGS. 3A and 3B, the screw housing 340 comprises a conical internal thread 346. This is not a thread that is demolded by unscrewing, for example. In some examples, the conical internal thread 346 is produced by means of milling, at least in part. However, the same as was stated in connection with FIGS. 3A and 3B also applies to the apertures 356 and a deformation of the internal thread 346 promoted thereby.

Figure 5A:
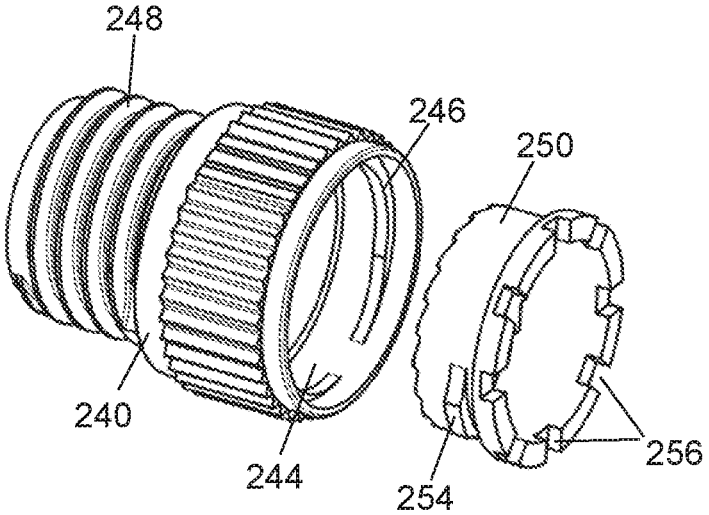
FIG. 5A-5B schematically show different perspective views of a screw housing and a stopper for a circular plug-in connector according to another embodiment.

FIG. 5A schematically shows a perspective view of a screw housing 240 and a stopper 250 according to another example. The screw housing 240 and the stopper 250 are those described in connection with FIG. 2, for example. An undercut contour 246 and a corresponding mating undercut contour 254 on the outer face of the stopper 250 can be seen in the region of the receiving opening 244. The undercut contour 246 and the mating undercut contour 254 allow the stopper 250 to be fastened to the screw housing 240 by being inserted and twisted.

The stopper 250 also comprises a plurality of apertures 256. Said apertures promote deformation of the undercut contour 246 after the stopper 250 has been inserted and twisted, as described previously. The stopper 250 can thus be irreversibly fastened in the screw housing 240, for example. In some examples, the screw housing 240 and the stopper 250 are produced by milling, at least in part, in order to form the undercut contour 246 and the mating undercut contour 254.

Figure 5B:
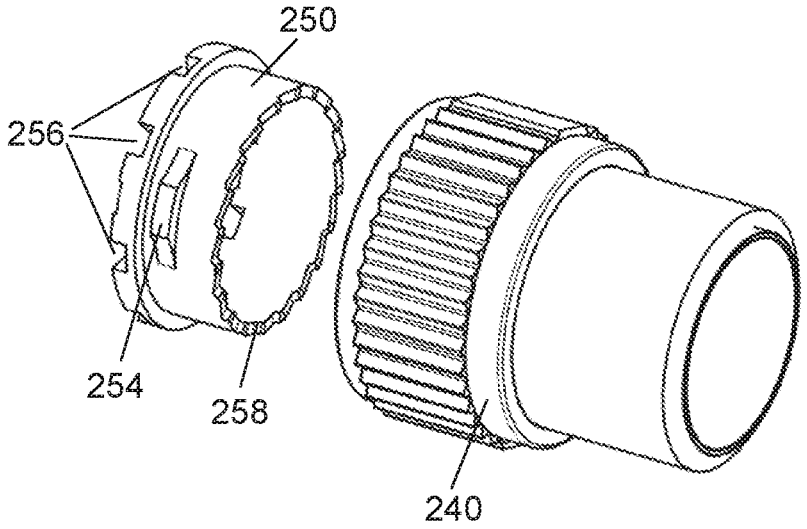

FIG. 5B schematically shows another perspective view of the screw housing 240 and the stopper 250. An end contour 258 on the end face of the stopper 250 can be seen. The end contour 258 is provided for forming vibration protection together with a mating contour on the collar of the shielding sleeve.

Figure 6:
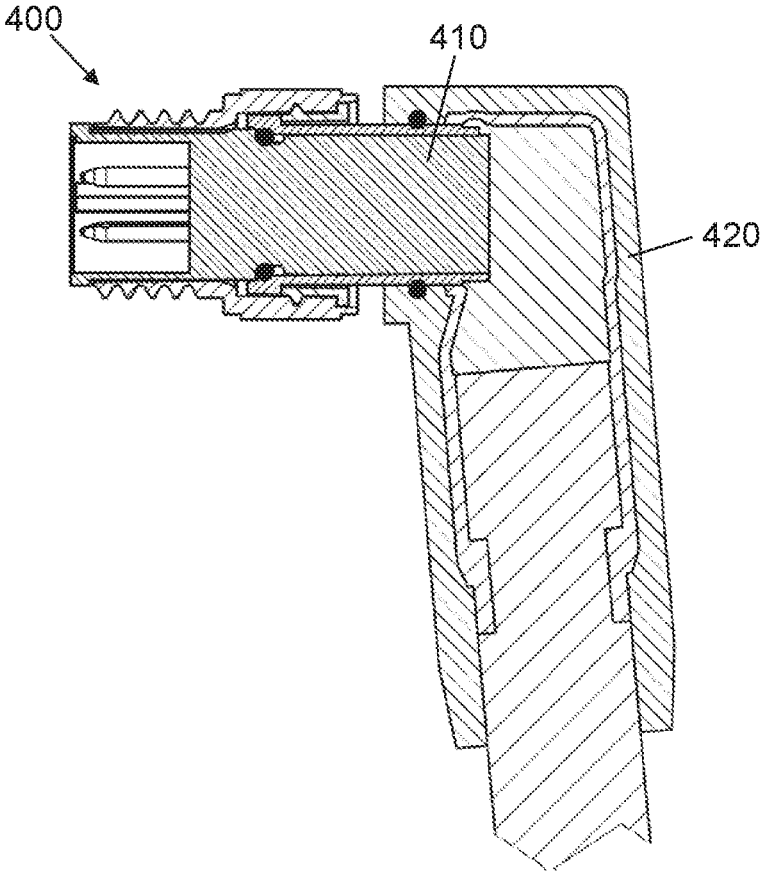
FIG. 6 schematically shows a cross-sectional view of a circular plug-in connector according to another embodiment.

FIG. 6 schematically shows a cross-sectional view of a circular plug-in connector 400 according to another embodiment. Unless indicated otherwise in the following, the same as was stated in connection with the circular plug-in connectors 100, 200 from FIGS. 1 and 2 also applies to the circular plug-in connector 400.

Unlike the circular plug-in connectors 100, 200, the circular plug-in connector 400 is an angled plug-in connector. The grip body 420 is therefore designed such that a longitudinal axis of the contact carrier 410 that is parallel to the plug-in direction is angled with respect to an input direction of the connected cable. As shown in FIG. 6, the techniques previously described in connection with straight plug-in connectors 100, 200 can also be used similarly with angled circular plug-in connectors 400.

Similarly to the example from FIG. 1, a screw connection between the stopper and the screw housing is also provided in the circular plug-in connector 400. However, as described above, other techniques for fastening the stopper to the screw housing, for example any of the techniques described in connection with FIG. 3A to 5, can also be used in the circular plug-in connector 400.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

100, 200, 400—circular plug-in connector
110, 410—contact carrier
112—contact element
120, 420—grip body
130—shielding sleeve
132—connection portion
134—collar
136*a*, 136*b*—sealing element
140, 240, 340—screw housing
142—receiving space
144, 244—receiving opening
146, 346—internal thread
148, 248, 348—screw thread
150, 250, 350—stopper
152—end face
154, 354—external thread segment
156, 256, 356—aperture
158, 258—end contour
246—undercut contour
254—mating undercut contour
K—cable
S—plug-in direction

What is claimed is:

1. A circular plug-in connector for establishing a shielded plug-in connection to a mating plug-in connector, comprising:

a contact carrier having at least one electrical contact element;

a shielding sleeve that surrounds the contact carrier at least in part; and a screw housing that is rotatably connected to the shielding sleeve and configured to screw the circular plug-in connector to the mating plug-in connector, wherein a connection portion of the shielding sleeve is received in a receiving space of the screw housing, wherein the circular plug-in connector is configured such that there is shielded contact between the screw housing and the shielding sleeve, wherein the shielding sleeve comprises a collar in the connection portion, wherein the circular plug-in connector further comprises a stopper configured to close a receiving opening of the receiving space at least in part, such that the collar is trapped in the receiving space, wherein the stopper comprises an end face that is configured for planar contact with the collar when the circular plug-in connector is screwed to the mating plug-in connector part by the screw housing, and wherein the end face comprises an end contour configured to engage in a mating contour of the collar when the circular plug-in connector is screwed to the mating plug-in connector part by the screw housing in order to provide vibration protection.

2. The circular plug-in connector according to claim 1, wherein the stopper is configured to be fastened to the screw housing by being screwed in and/or by being inserted and twisted, in order to close the receiving opening at least in part.

3. The circular plug-in connector according to claim 2, wherein the screw housing comprises at least one internal thread and/or at least one internal thread segment in a region of the receiving opening, and the stopper comprises at least one external thread and/or at least one external thread segment for screwing the stopper into the receiving opening.

4. The circular plug-in connector according to claim 3, wherein the internal thread and/or the internal thread segment comprises an internal thread demolded by unscrewing and/or an internal thread segment demolded by unscrewing, and the screw housing and the stopper are zinc die cast at least in part.

5. The circular plug-in connector according to claim 4, wherein the internal thread and/or the internal thread segment comprises a conical internal thread and/or a conical internal thread segment that is milled at least in part.

6. The circular plug-in connector according to claim 2, wherein the screw housing comprises at least one undercut contour in a region of the receiving opening, and the stopper comprises, on an outer face, at least one mating undercut contour that is configured to be brought into engagement with the undercut contour of the screw housing in order to fasten the stopper in the receiving opening by plugging-in and twisting.

7. The circular plug-in connector according to claim 6, wherein the screw housing and the stopper are milled at least in part.

8. The circular plug-in connector according to claim 7, wherein the stopper comprises at least one aperture that is configured for press-fitting an internal thread and/or an internal thread segment and/or an undercut contour of the screw housing when the stopper is fastened to the screw housing.

9. The circular plug-in connector according to claim 2, wherein the stopper is non-detachably fastenable to the screw housing by press-fitting at least one thread, an undercut contour, and/or material of the circular plug-in connector in a region that is adjacent to an undercut contour of the circular plug-in connector.

10. The circular plug-in connector according to claim 1, wherein the receiving opening is configured so as to allow the connection portion of the shielding sleeve to be inserted into the receiving space when the receiving opening is not at least partially closed by the stopper.

11. The circular plug-in connector according to claim 1, wherein the screw housing is connected to the shielding sleeve so as to be rotatable about a longitudinal axis of the contact carrier that is parallel to a plug-in direction.

12. The circular plug-in connector according to claim 1, wherein the screw housing comprises at least one screw thread configured to screw to the mating plug-in connector part.

13. The circular plug-in connector according to claim 1, wherein the screw housing surrounds the contact element, at least in part, in a direction radial to a longitudinal axis of the contact carrier.

14. The circular plug-in connector according to claim 1, wherein the circular plug-in connector comprises an angled circular plug-in connector.

15. The circular plug-in connector according to claim 1, wherein the circular plug-in connector comprises a straight circular plug-in connector.

* * * * *